US009063457B2

(12) United States Patent
Fujii

(10) Patent No.: US 9,063,457 B2
(45) Date of Patent: Jun. 23, 2015

(54) ROLLER COVER AND CARTRIDGE

(71) Applicant: Yasumasa Fujii, Anjo (JP)

(72) Inventor: Yasumasa Fujii, Anjo (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/171,952

(22) Filed: Feb. 4, 2014

(65) Prior Publication Data

US 2014/0155237 A1 Jun. 5, 2014

Related U.S. Application Data

(63) Continuation of application No. 13/052,274, filed on Mar. 21, 2011, now Pat. No. 8,676,086.

(30) Foreign Application Priority Data

Mar. 24, 2010 (JP) ..... 2010-068574

(51) Int. Cl.
*G03G 15/04* (2006.01)
*G03G 21/18* (2006.01)
*G03G 15/08* (2006.01)

(52) U.S. Cl.
CPC ..... *G03G 15/0818* (2013.01); *G03G 21/1832* (2013.01); *G03G 15/0822* (2013.01); *G03G 2215/0692* (2013.01); *G03G 2215/0877* (2013.01)

(58) Field of Classification Search
USPC ..... 399/111, 114, 119, 265, 279, 411
IPC ..... G03G 21/1676,21/1832, 2215/0875, G03G 2215/0877
See application file for complete search history.

(56) References Cited

U.S. PATENT DOCUMENTS 7,428,386 B2 * 9/2008 Itabashi ..... 399/12
7,929,881 B2 4/2011 Yoshino et al.
8,095,036 B2 1/2012 Yoshino et al.

(Continued)

FOREIGN PATENT DOCUMENTS

JP 2001-282079 A 10/2001
JP 2003-195730 A 7/2003

(Continued)

OTHER PUBLICATIONS

Chinese Office Action issued in Application No. 201110075916.5, mailed Oct. 8, 2012.

(Continued)

*Primary Examiner* — Robert Beatty
(74) *Attorney, Agent, or Firm* — Merchant & Gould PC

(57) ABSTRACT

A roller cover, which is to be attached to a housing, the roller cover comprising: a protecting portion, which faces the circumference of the roller when the roller cover is attached to the housing; a first end portion, which is provided at one side of the protecting portion in an orthogonal direction; a second end portion; a first opposite portion, which is formed continuously with the first end portion, wherein the first opposite portion is fitted to one side of the housing in the orthogonal direction; and a second opposite portion fitted to the other side of the housing, wherein a first distance between the first opposite portion and the second opposite portion increases during an attachment operation, and wherein, when the attachment operation is completed, a final distance between the first opposite portion and the second opposite portion is less than maximum value of the first distance.

16 Claims, 12 Drawing Sheets

(56) References Cited

U.S. PATENT DOCUMENTS

| | | | |
|---|---|---|---|
| 8,326,178 | B2 | 12/2012 | Nakamura et al. |
| 2011/0103835 | A1 | 5/2011 | Hayashi et al. |

FOREIGN PATENT DOCUMENTS

| | | | |
|---|---|---|---|
| JP | 2004-264757 | A | 9/2004 |
| JP | 2004-280012 | A | 10/2004 |
| JP | 2006-39314 | A | 2/2006 |
| JP | 2006-337532 | A | 12/2006 |
| JP | 2008-298972 | A | 12/2008 |
| JP | 2009-186547 | A | 8/2009 |
| JP | 2011-095596 | A | 5/2011 |

OTHER PUBLICATIONS

Chinese Office Action issued in Application No. 201110075915.5, mailed Nov. 28, 2013.

Japanese Office Action issued in application 2010-068574, mailed Feb. 14, 2012.

* cited by examiner

ROLLER COVER AND CARTRIDGE

CROSS-REFERENCE TO RELATED APPLICATION

This application is a continuation application of U.S. patent application Ser. No. 13/052,274, filed Mar. 21, 2011, which further claims priority from Japanese Patent Application No. 2010-068574 filed on Mar. 24, 2010, the entire subject matter of both of which are incorporated herein by reference.

BACKGROUND

1. Technical Field

The present invention relates to a cartridge to be mounted to an image forming apparatus such as a laser printer, and a roller cover to be attached to the cartridge.

2. Background

A cartridge, for example 1 a developing cartridge, is removably mounted to a main body in an image forming apparatus, such as a laser printer, has been known.

The developing cartridge has a housing to accommodate a toner in its inside and a developing roller carrying a toner at its circumference. The developing roller is rotatably supported at both sidewalls of the housing, and a portion of the circumference is exposed trough the housing.

When developing cartridge is not mounted to an image forming apparatus, a portion of a developing roller is exposed from the housing, and the exposed portion may be damaged during a transition of the developing cartridge. So, when the developing cartridge is not mounted to the image forming apparatus, a developing roller cover is attached to the developing cartridge for protecting a developing roller.

Such developing roller cover is made of, for example, resin material. When the developing roller cover is attached to a developing cartridge, a developing roller cover includes a cover portion, which faces a developing roller throughout its axial direction, and a pair of engage portions, which is provided at to both end portions of the cover portion in an axial direction and is protruded perpendicularly. In attachment operation of the developing roller cover, while one of the engage portions is engaging to a housing of the developing cartridge, the other of the engage portions is extended toward outside of the axial direction and the developing roller cover is pivoted with respect to the one side of the engage portion as a pivot point. Thus, the other side of the engage portion is engaged to the housing. As a result, the attachment operation of a developing roller cover to a developing cartridge is completed.

SUMMARY

However, in the above configuration, it is required to maintain a state that one side of the engage portion is being engaged with the housing, until a attachment operation of a developing roller cover is completed. That is, it is necessary that the other side of the engage portion is extended towards outside of the axial direction and the developing roller cover is pivoted while one side of the engage portion is being engaged with the housing. Accordingly, it requires a care to attach the developing roller cover to the developing cartridge.

In view of the above, the present invention provides a developing roller cover configured to improve operability in attachment operation of a developing cartridge and the developing roller attached with the cover developing cartridge.

The roller cover of the present invention, the roller cover being to be attached to a housing of a cartridge, which accommodates developer and includes a roller of which a circumference is exposed through an opening longitudinally formed in the housing, the roller cover comprising: a protecting portion, which extends longitudinally in an axial direction of the roller, and which faces the circumference of the roller when the roller cover is attached to the housing; a first end portion, which is provided at one side of the protecting portion in an orthogonal direction, wherein the orthogonal direction is orthogonal to the axial direction; and wherein the orthogonal direction is also orthogonal to a facing direction, which is a direction between the roller and the protecting portion; a second end portion, which is provided at one other side of the protecting portion in the orthogonal direction; a first opposite portion, which is formed continuously with the first end portion, wherein the first opposite portion is fitted to one side of the housing in the orthogonal direction when the roller cover is attached to the housing; and a second opposite portion, which is formed continuously with the second end portion, wherein the second opposite portion is fitted to the other side of the housing in the orthogonal direction when the roller cover is attached to the housing, wherein a first distance between the first opposite portion and the second opposite portion increases during an attachment operation, and wherein, when the attachment operation is completed, a final distance between the first opposite portion and the second opposite portion is less than maximum value of the first distance.

A cartridge of present invention includes: a roller; a housing, which includes an opening longitudinally formed in an axial direction of the roller, and which accommodates developer and exposes a circumference of the roller through the opening, the roller cover including: a protecting portion, which extends longitudinally in an axial direction of the roller, and which faces the circumference of the roller when the roller cover is attached to the housing; a first end portion, which is provided at one side of the protecting portion in an orthogonal direction, wherein the orthogonal direction is orthogonal to the axial direction; and wherein the orthogonal direction is also orthogonal to a facing direction, which is a direction between the roller and the protecting portion; a second end portion, which is provided at one other side of the protecting portion in the orthogonal direction; a first opposite portion, which is formed continuously with the first end portion, wherein the first opposite portion is fitted to one side of the housing in the orthogonal direction when the roller cover is attached to the housing; and a second opposite portion, which is formed continuously with the second end portion, wherein the second opposite portion is fitted to the other side of the housing in the orthogonal direction when the roller cover is attached to the housing, wherein a first distance between the first opposite portion and the second opposite portion increases during an attachment operation, and wherein, when the attachment operation is completed, a final distance between the first opposite portion and the second opposite portion is less than maximum value of the first distance.

According to the present invention, the housing of the cartridge has an opening longitudinally in the axial direction of the roller. The roller is supported at a housing to expose the circumference through the opening. Also, a roller cover is attached order to the housing to protect the roller.

A roller cover includes a protecting portion, a first opposite portion and a second opposite portion. When a roller cover is attached to a cartridge (an attached state), the protecting portion faces a circumference of the roller and is formed into a longitudinally shape extending to the axial direction. As a result, when a roller cover is attached to a cartridge, the roller can be protected by the protecting portion, and the circumference of the roller is prevented from damages.

In a orthogonal direction perpendicular to both a longitudinal direction in the protecting portion and a facing direction between the protecting portion and the roller, the first opposite portion is formed continuously with a first end portion of one side of the protecting portion fitted to one side of the housing in the orthogonal direction when the roller cover is attached to the housing. Also, a second opposite portion formed continuously with a second end portion of the other side of the orthogonal direction in the protecting portion fitted to the housing in the orthogonal direction when the roller cover is attached to the housing. That is, when the roller cover is attached to the housing, the housing is sandwiched between the first opposite portion and the second opposite portion from both sides of the orthogonal direction.

When the roller cover is attached to the housing, the first opposite portion and the second opposite portion are fitted with the housing, and a first interval is a distance between the first opposite portion and the second opposite portion in orthogonal direction. During the attachment operation of the roller cover to developing cartridge, an interval between the first opposite portion and the second opposite portion in an orthogonal direction becomes larger than the first interval. Therefore, during an attachment operation, restoring force is occurred and make the interval between the first opposite portion and the second opposite portion be smaller. The housing is sandwiched by the restoring force, and the attachment operation of a roller cover to the housing is completed. As a result, an operability in attachment operation of a developing roller cover can be improved.

DETAILED DESCRIPTION OF ILLUSTRATIVE ASPECTS

Hereinafter, an illustrative aspect of the present invention will be described in detail with reference to the accompanying drawings.

1. Entire Configuration of Laser Printer

Figure 1:
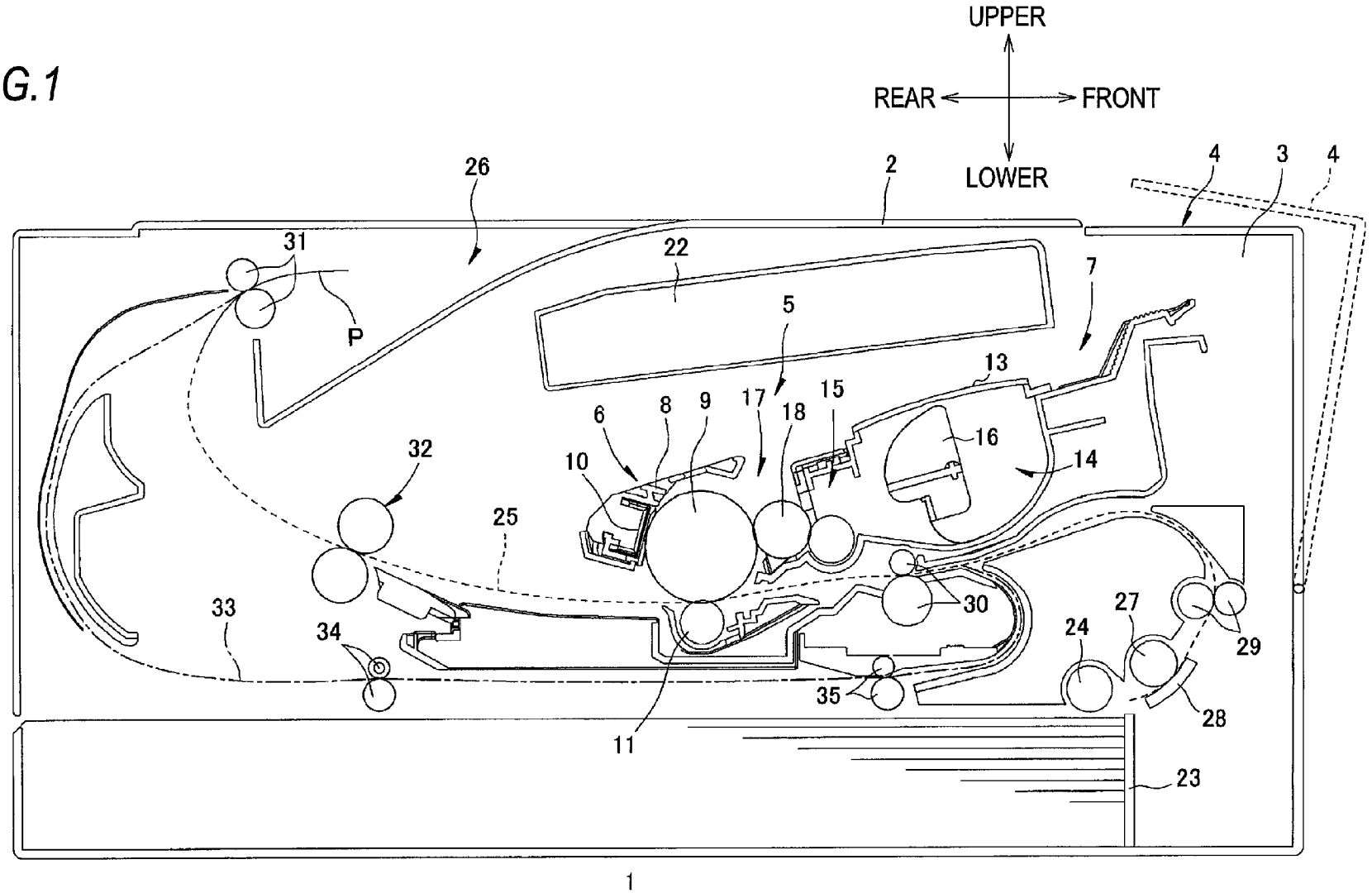
FIG. 1 is a cross sectional side view illustrating a printer according to one illustrative aspect of the present invention.

As illustrated in FIG. 1, a laser printer 1, which is one example of an image forming apparatus, has a main body casing 2, as one example of a device main body. A cartridge mount opening 3 is formed at one sidewall of the main body casing 2, and a front cover 4 opening and closing the cartridge mount opening 3 is provided.

Incidentally, in the following description, a side provided a front cover 4 is defined as a front side of the laser printer 1. An upper-lower direction and a left-right direction of the laser printer 1 are defined on the basis of a view when viewed from the front side of the laser printer 1. In addition, the front-rear direction of a developing cartridge 7 (which will be described) are defined on the basis of a mounted state to the main body casing 2, and the upper-lower direction and the left-right direction of developing cartridge 7 are defined on the basis of a view when viewed from the front side the developing cartridge 7.

A process cartridge 5 is provide at a slightly front side position of the center of an main body casing 2. While the front cover 4 is opening, the process cartridge 5 is to be mounted in the main body casing 2 through the cartridge mount opening 3 and removed from the inside of the main body casing 2.

The process cartridge 5 includes a drum cartridge 6 and the developing cartridge 7 removably mounted to the drum cartridge 6.

The drum cartridge 6 includes a drum frame 8. A photosensitive drum 9 is rotatably supported at the rear end portion of the drum frame 8. Also, an electric charger 10 and a transfer roller 11 are supported in the drum frame 8. Each of the electric charger 10 and the transfer roller 11 is respectively disposed at the rear side and down side of the photosensitive drum 9.

A portion of the drum frame 8, the portion being located in front side of the photosensitive drum 9, is referred to as a developing cartridge mounting portion 12. The developing cartridge 7 is to be mounted to the developing cartridge mounting portion 12.

The developing cartridge 7 includes the housing 13 accommodating a toner. A toner accommodation room 14 and a development room 15 are communicated to each other and are adjacent rear and forth.

An agitator 16 is rotatably provided in the toner accommodation room 14. By the rotation of the agitator 16, the toner accommodated in the toner accommodation room 14 is agitated, and then the toner is moved from the toner accommodation room 14 to the development room 15.

Each of a developing roller 18 and a supplying roller 19 is rotatably provided in the development room 15. The developing roller 18 is disposed to expose a portion of the circumference through the rear end portion of the housing 13. The developing cartridge 7 is mounted to the drum cartridge 6 so that a circumference of the developing roller 18 contacts the circumference of the photosensitive drum 9. The supplying roller 19 is disposed so that a circumference of the supplying roller 19 contacts a front lower portion of the circumference of the developing roller 18. The toner in the development room 15 is supplied to the circumference of the developing roller 18 by the supplying roller 19 and hold on the circumference of the developing roller 18 as a thin layer.

Also, an exposing unit 22 having, for example, a laser unit is disposed above the process cartridge 5 in the main body casing 2.

When forming images, the photosensitive drum 9 rotates at a certain speed in a clockwise direction in FIG. 1. With the rotation of the photosensitive drum 9, the circumference (surface) of the photosensitive drum 9 is evenly electrically-charged by discharge from an electric charger 10. Meanwhile, a laser beam is irradiated from an exposing unit 22, and the laser beam passes between the electric charger 10 and the developing cartridge 7. The laser beam is irradiated on the circumference of the photosensitive drum 9 that is evenly and positively electrically-charged. As a result, the circumference of the photosensitive drum 9 is selectively is electrically-exposed. Accordingly, the electrically-charge is selectively removed from an exposed portion of the photosensitive drum 9, and an electrostatic latent image on the circumference of the photosensitive drum 9 is formed. When the electrostatic latent-image of the photosensitive drum 9 faces the developing roller 18 by the rotation, the toner is provided to the electrostatic latent-image from the developing roller 18. As a result, a toner image is formed on the circumference of the photosensitive drum 9.

A sheet-feeding cassette 23 receiving a sheet P is disposed at a lower portion of the main body casing 2. A pick-up roller 24 for feeding paper from the sheet-feeding cassette 23 is provided above the sheet-feeding cassette 23.

Also, a convey path 25, which has an S-shape when viewed form a side view, is formed in the main body casing 2. The convey path 25 extends from a sheet-feeding cassette 23 through between the photosensitive drum 9 and a transfer roller 11 to sheet-discharge tray 26 formed at an upper surface of the main body casing 2. A separation roller 27 and a separation pad 28 facing to each other, a pair of feeding rollers 29, a pair of register rollers 30 and a pair of discharging rollers 31 are provided on the convey path 25.

The sheet P fed from the sheet-feeding cassette 23 passes between the separation roller 27 and the separation pad 28 and is separated to a piece of the sheet. The separated sheet P is conveyed toward a register roller 30 by the feeding roller 29, and then, the sheet P is registered by the register roller 30 conveyed toward between the photosensitive drum 9 and a transfer roller 11.

When the toner image on the circumference of the photosensitive drum 9 faces a sheet P, which is passed through between the photosensitive drum 9 and a transfer roller 11, by rotation of the photosensitive drum 9, the toner image is electrically drawn by the transfer roller 11 and is transferred on the sheet P.

A fixing unit 32 is provided at a downstream side of the transfer roller 11 in a convey direction on the convey path 25. The sheet P having the transferred toner image is conveyed through the convey path 25 and passes through the fixing unit 32. In the fixing unit 32, the toner image fixed on the sheet P as an image by heating and pressurizing.

A operation mode of the laser printer 1 includes one-sided mode, in which a image (toner image) is formed on one side surface of sheet P, and double-sided mode, in which a image is formed on one side surface of sheet P, after that a image is formed on the other side surface of the opposite side of one side surface of the sheet P.

In one-sided mode, a sheet P formed an image at one side is discharged to a sheet-discharge tray 26 by a discharging roller 31.

For achieving a double-sided mode, a reverse convey path 33 is formed in the main body casing 2. The reverse convey path 33 extends from the vicinity of the discharging roller 31 through between the convey path 25 and the sheet-feeding cassette 23 and connected to a portion between the feeding roller 29 and the register roller 30, in the convey path 25. A pair of first reverse convey rollers 34 and a pair of second reverse convey rollers 35 are provided at the reverse convey path 33.

In the double-sided mode, the sheet P is not discharged to the sheet-discharge tray 26 after an image is formed on only one side of a sheet P, but the sheet P is conveyed to a reverse convey path 33. And, the sheet P is conveyed through the reverse convey path 33 by first reverse convey rollers 34 and second reverse convey rollers 35 with reversing the sheet, and the other side, which is not formed an image, conveyed to the convey path 25 so as to face the circumference of the photosensitive drum 9. As a result, an image is formed on the other side of the sheet P, a double-sided image formation of a sheet P is achieved.

2. Developing Cartridge

Figure 2:
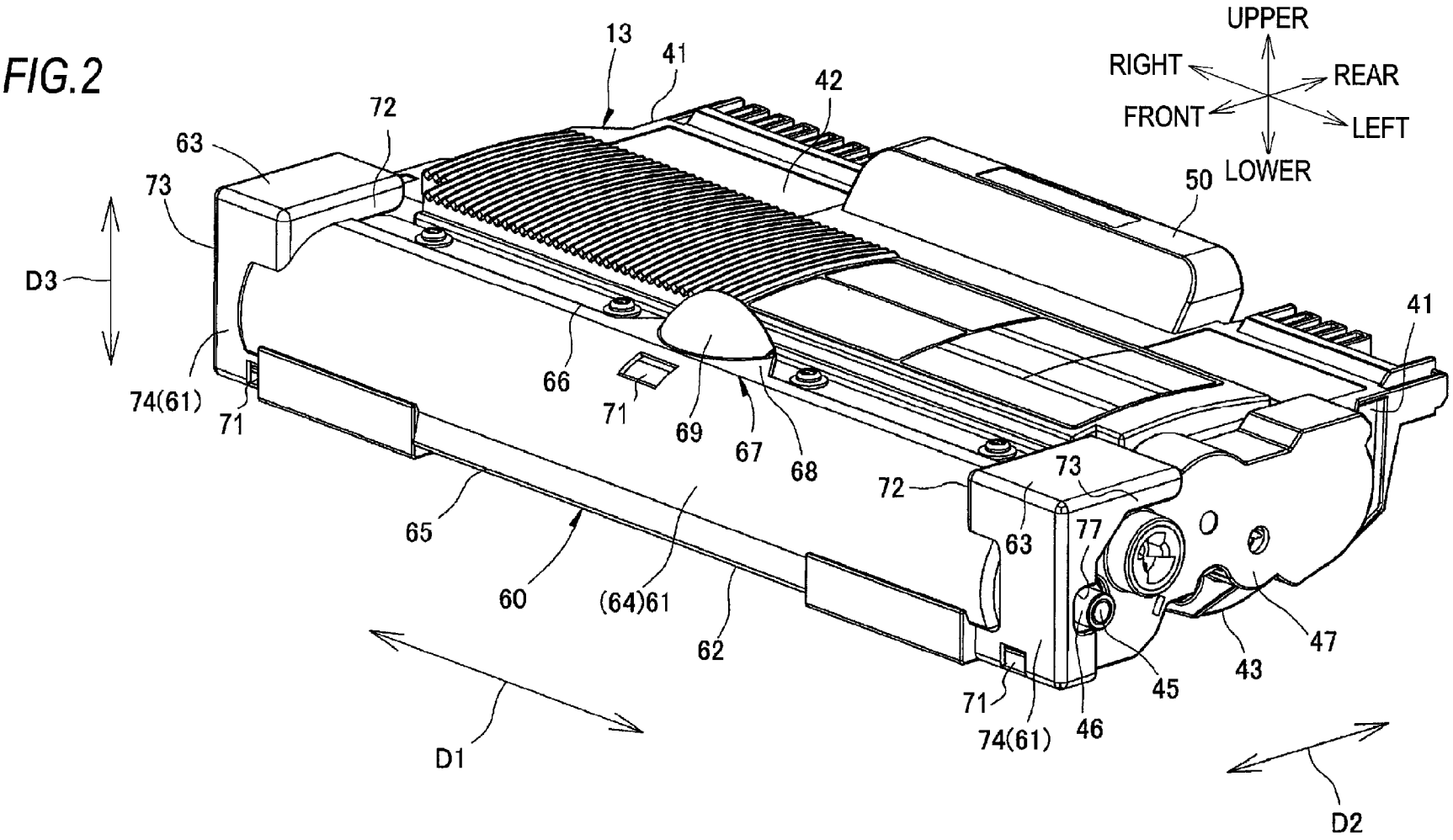
FIG. 2 is a perspective view illustrating a developing cartridge shown in FIG. 1, and showing a attached state of a developing roller cover to a developing cartridge.
Figure 5:
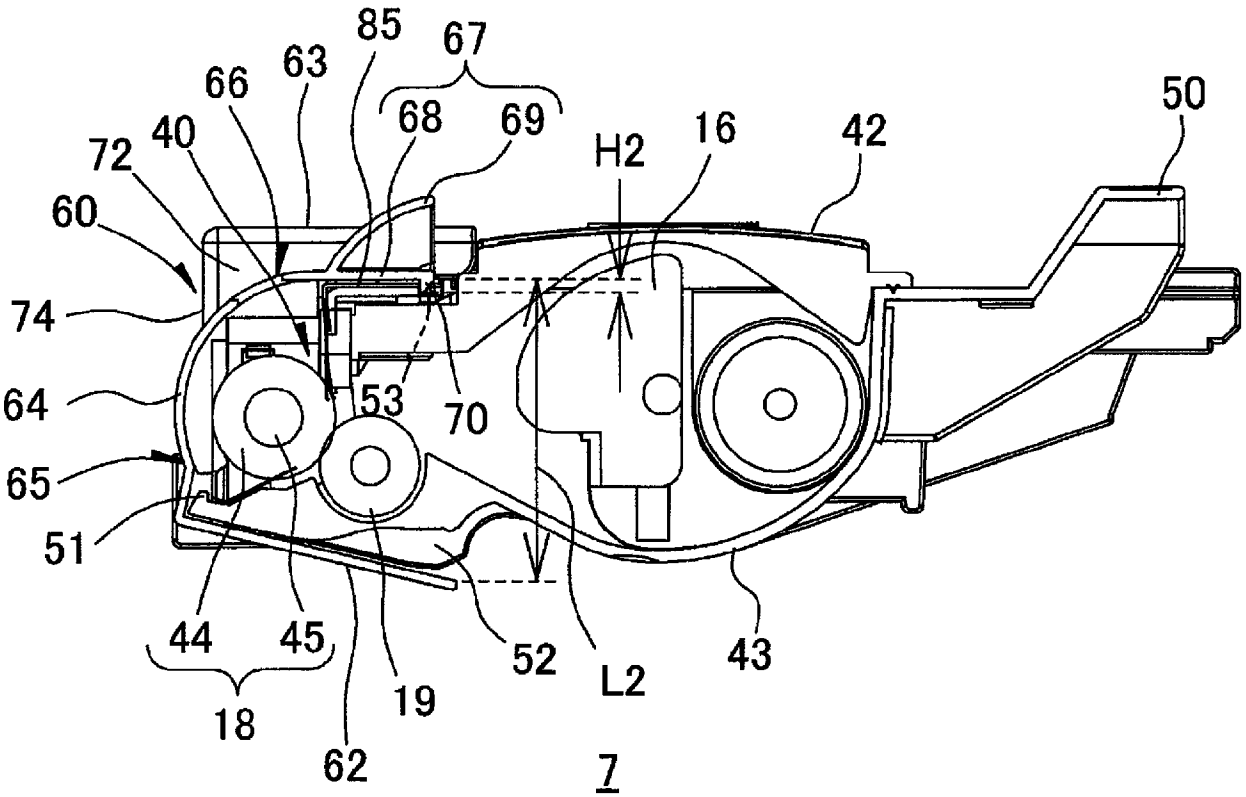
FIG. 5 is a cross sectional side view illustrating a developing roller cover shown in FIG. 2.

As illustrated in FIG. 2, the housing 13 of a developing cartridge 7 has a pair of sidewalls 41 facing each other in the left-right direction. Each sidewall 41 has a plate shape extending in the front-rear direction. The housing 13 has an upper wall 42 provided between upper end portions of each sidewall 41, and a lower wall 43 provided between lower end portions of each sidewall 41. As shown in FIG. 5, the upper wall 42 and the lower wall 43 are connected at the front end portion of the housing 13. Thus, the housing 13 has a box shape having an opening 40 opened toward a rear-side at the rear end portion.

Figure 3:
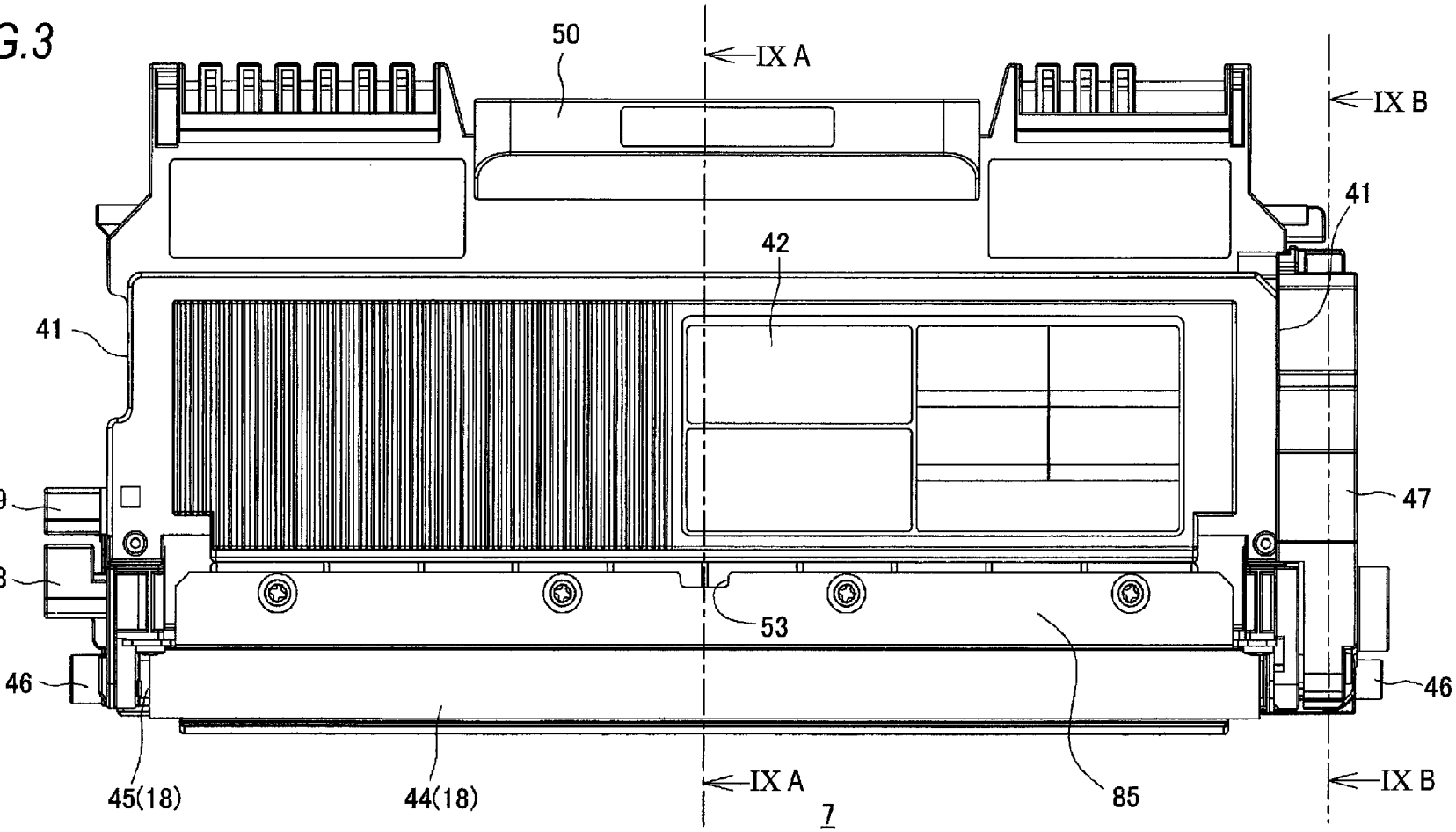
FIG. 3 is a plan view illustrating a developing cartridge shown in FIG. 1.

As shown in FIG. 3, a developing roller 18 is supported between rear end portions of a pair of sidewalls 41. The developing roller 18 includes a developing roller main body 44 and a developing roller shaft 45 extending in axial direction of the developing roller main body 44. Both end portions of the developing roller shaft 45 are protruded from the developing roller main body 44. And, a collar member 46 is provided at both end portions of the developing roller shaft 45 to surround the circumferences protruded from each sidewall 41 in the left-right direction.

A gear cover 47 is provided at outside of the left side sidewall 41. As viewed from the rear side, the gear cover 47 has a reversed-C-shape, which is opened toward the left sidewall 41. A plurality of gears (not shown) is provided between the left side sidewall 41 and the gear cover 47.

A development electrode 48 and a supplying electrode 49 are provided outside of a right side sidewall 41. The development electrode 48 is disposed at the rear end portion of the right sidewall 41 and electrically connected to the developing roller shaft 45. Also, the supplying electrode 49 is disposed in front of the development electrode 48 and is electrically connected to a supplying roller shaft (not shown) of the supplying roller 19.

The upper wall 42 is formed into a plate shape extending in the front-rear direction. The rear end portion of the upper wall 42 is disposed at a front side relative to the rear end portion of the developing roller main body 44, when viewed from a plan view. Accordingly, a circumference of the developing roller main body 44 is exposed toward the upper direction through the housing 13.

Also, a front end portion of the upper wall 42 includes a cartridge handle portion 50. The cartridge handle portion 50 is extended from a center portion of the upper wall 42 in the left-right direction to a front upper direction.

Also, as shown in FIG. 5, a third engaged portion 53 is formed at the upper wall 43 of the developing cartridge 7, the third engaged portion 53 having an approximately rectangular shape to go down one step from an upper end. The third engaged portion 53 is formed at a position to face a third tab 70 (which will be described later) in the upper-lower direction when the roller cover 60 is attached to the developing cartridge 7.

Figure 4:
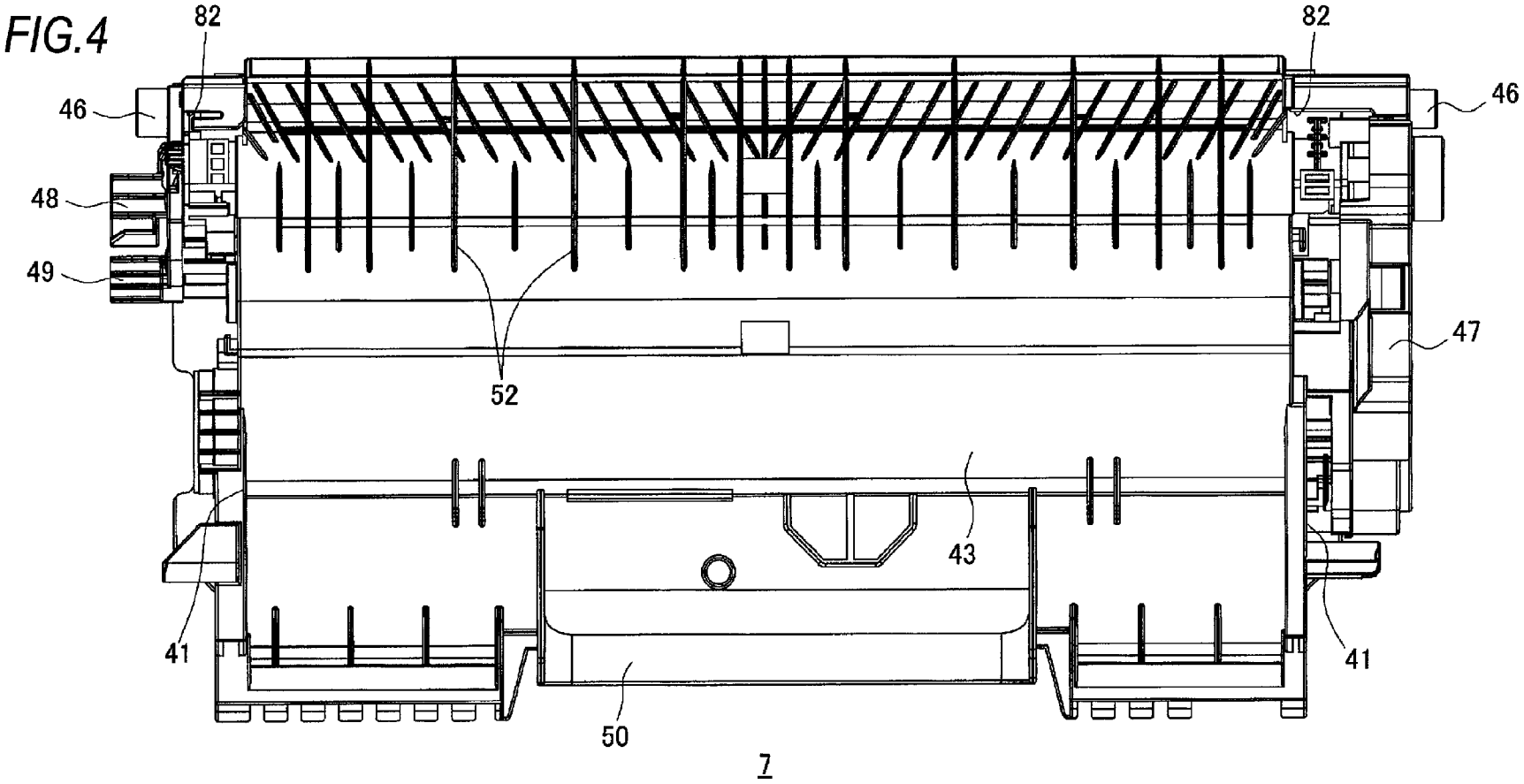
FIG. 4 is a bottom side view illustrating a developing cartridge shown in FIG. 1.

As shown in FIGS. 4 and 5, the lower wall 43 extends to the front-rear direction, and the front end portion of the lower wall 43 extends with curving upward and connects to the front end portion of the upper wall 42. When viewed from a plan view, the rear end portion of the lower wall 43 is protruded to a rear side relative to the rear end portion of the developing roller main body 44. And, as shown in FIG. 5, the protrusion portion is formed with a jaw portion 51 having hook shape extending upward. The jaw portion 51 extends throughout the entire width of the rear end portion of the lower wall 43 in the left-right direction. Also, a front end portion of the jaw portion 51 is close to a circumference of the developing roller main body 44.

Also, a plurality of sheet convey rib 52 protruding downward and extending in the front-rear direction is formed at the lower surface of the rear end portion of the lower wall 43. The sheet convey rib 52 is provided with an interval at the left-right direction to each other, and the lower surface is inclined with a certain tilt towards a front lower direction.

Figure 9A:
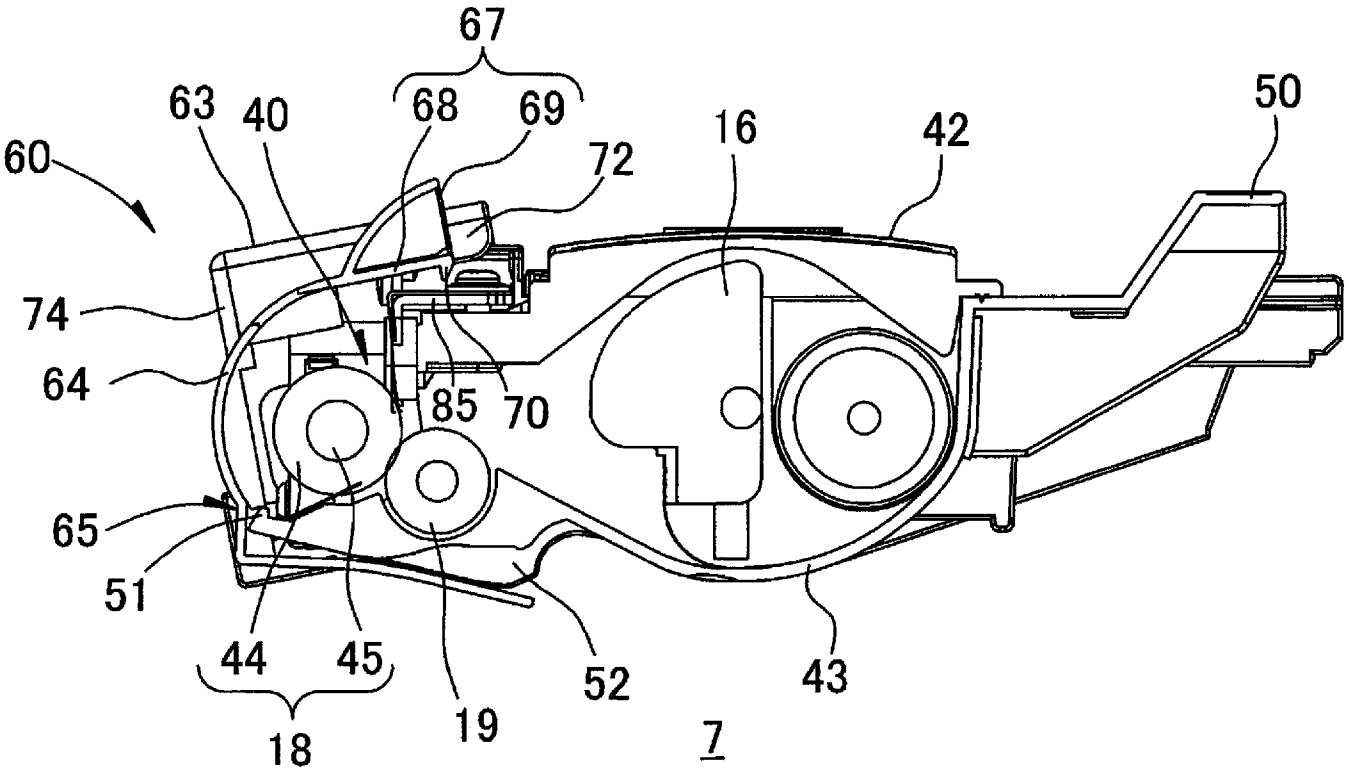
FIG. 9A is a cross-sectional view illustrating a developing cartridge taken along line IXA-IXA of shown in FIG. 3 during an attachment operation of a developing roller cover.
Figure 9B:
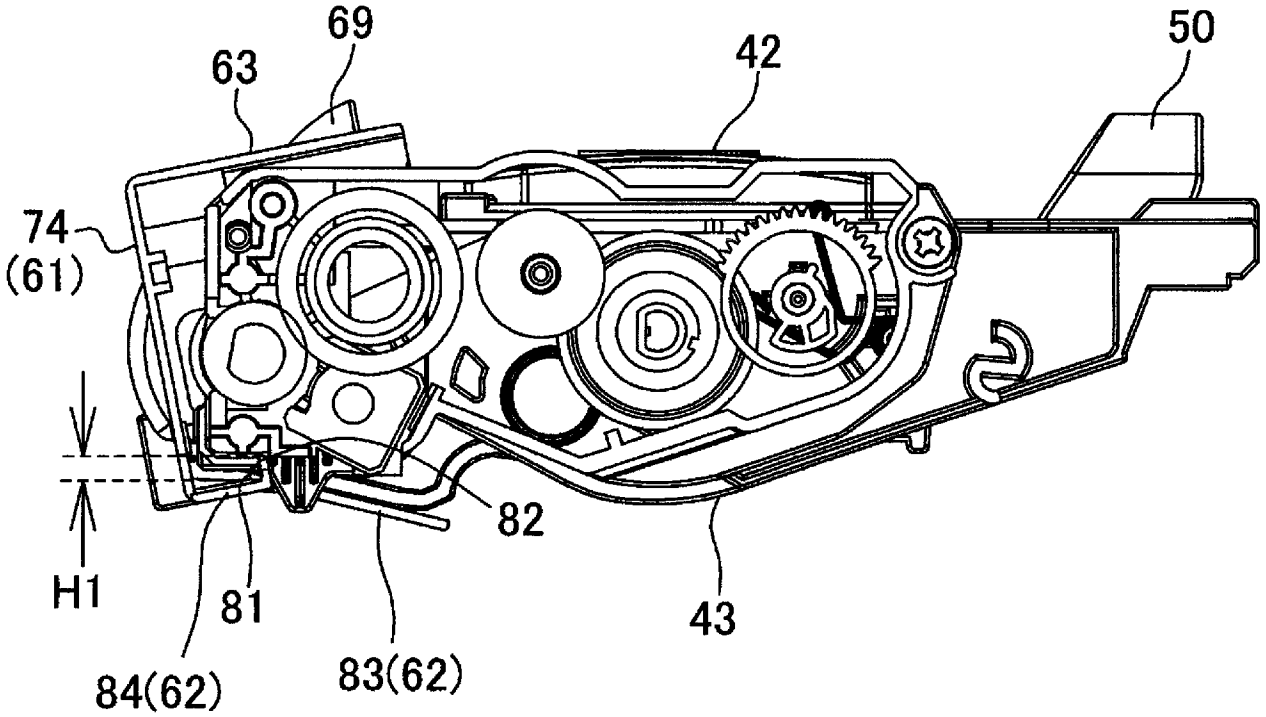
FIG. 9B is a cross-sectional view illustrating a developing cartridge taken along line IXB-IXB of shown in FIG. 3, when the attachment operation is completed.

Also, as shown in FIG. 9B, a first engaged portion 82 is formed at the lower wall 43 of the developing cartridge 7 with an approximately rectangular shape to go down one step from a lower end, and the first engaged portion 82 is formed at a position to face a first tab 81 (which will be described) in the upper-lower direction when the roller cover 60 is attached to the developing cartridge 7. Each of holes 71 is provided at a position where is corresponding to each of tabs.

3. Developing Roller Cover

As shown in FIG. 2, the developing roller cover 60 is attached to the developing cartridge 7.

The developing roller cover 60 is made of resin material having flexibility and includes a protecting portion 61, the first opposite portion 62 and the second opposite portion 63, integrally.

The protecting portion 61 includes a circular arc portion 64 and a plate shape portion 74.

The circular arc portion 64 faces a developing roller main body 44 from the rear side on the developing roller main body 44 (refer to FIG. 5) throughout the axial direction, when the roller cover 60 is attached to the developing cartridge 7. When viewed from a side view, the circular arc shape protrudes toward a radial direction of the developing roller main body 44.

The plate shaped portion 74 is provided at both ends of the circular arc portion 64 in the left-right direction. The plate shaped portion 74 is formed into rectangular plated shape extending to the upper-lower direction and the left-right direction, and the plate shaped portion 74 faces both of the rear end portion of sidewalls 41 of the housing 13, when the roller cover 60 is attached to the developing cartridge 7.

Hereinafter, a developing roller cover 60 will be explained, based on the attached state. That is, a longitudinal direction D1 of the protecting portion 61 (a arranged direction of the circular arc portion 64 and a plate shaped portion 74) is defined as a left-right direction, and a facing direction D2 of the protecting portion 61 and the developing roller 18 (developing roller main body 44) is defined as a front-rear direction. An orthogonal direction D3 perpendicular to both directions of the longitudinal direction D1 and the facing direction D2 is defined as a upper-lower direction.

A lower end portion of the protecting portion 61 (lower end portion of circular arc 64 and lower end portion of plate shaped portion 74) is a first end portion 65 disposed in a relatively lower side. Also, the upper end portion of the protecting portion 61 (upper end portion of circular arc portion 64 and upper end portion of plate shaped portion 74) is a second end portion 66 disposed in a relatively upper side.

Figure 6:
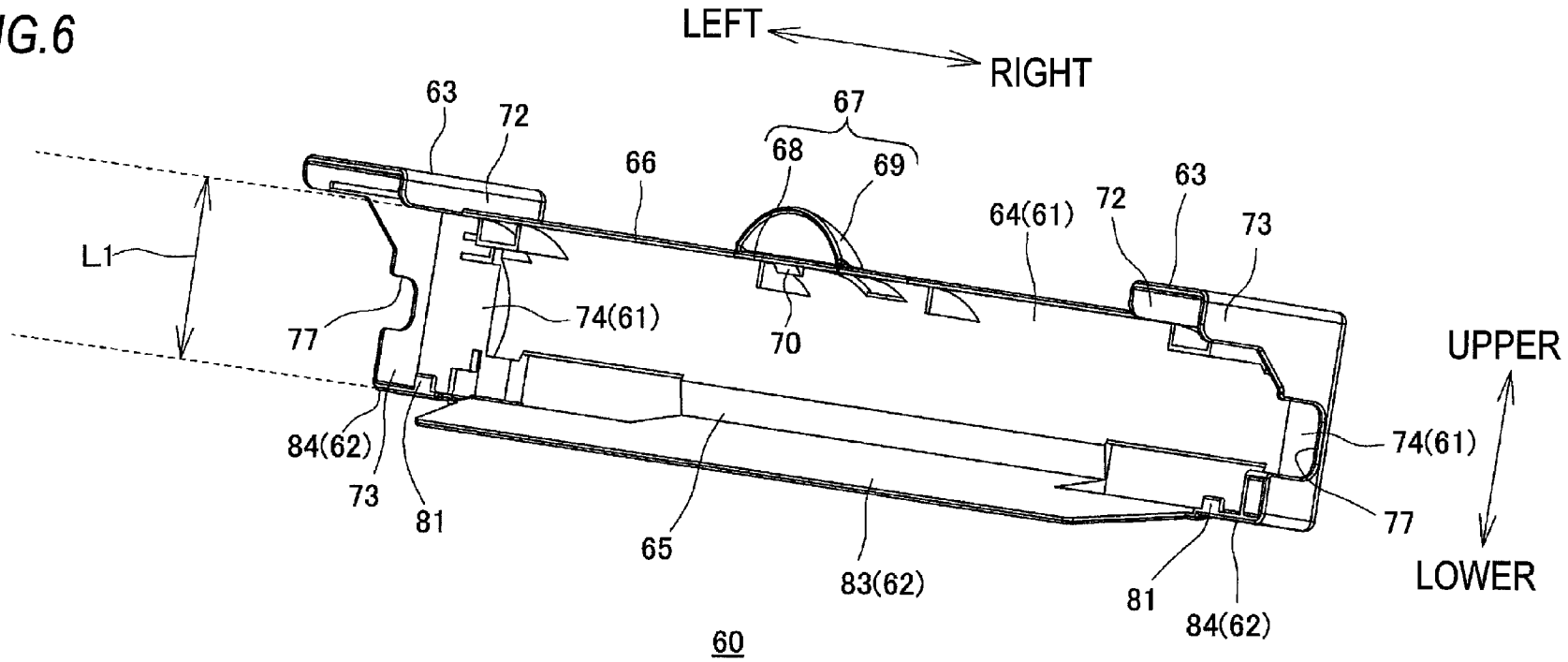
FIG. 6 is a perspective view illustrating a developing roller cover.
Figure 7:
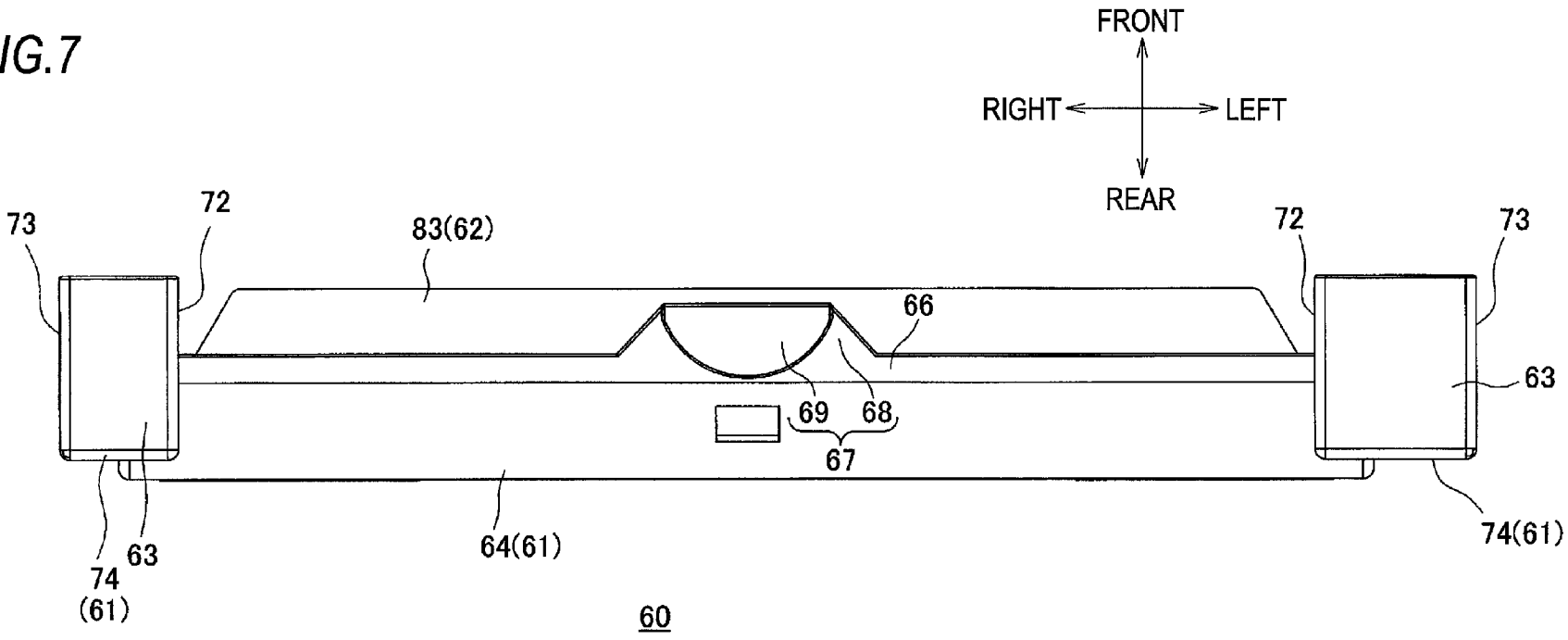
FIG. 7 is a plan view illustrating a developing roller cover.
Figure 8:
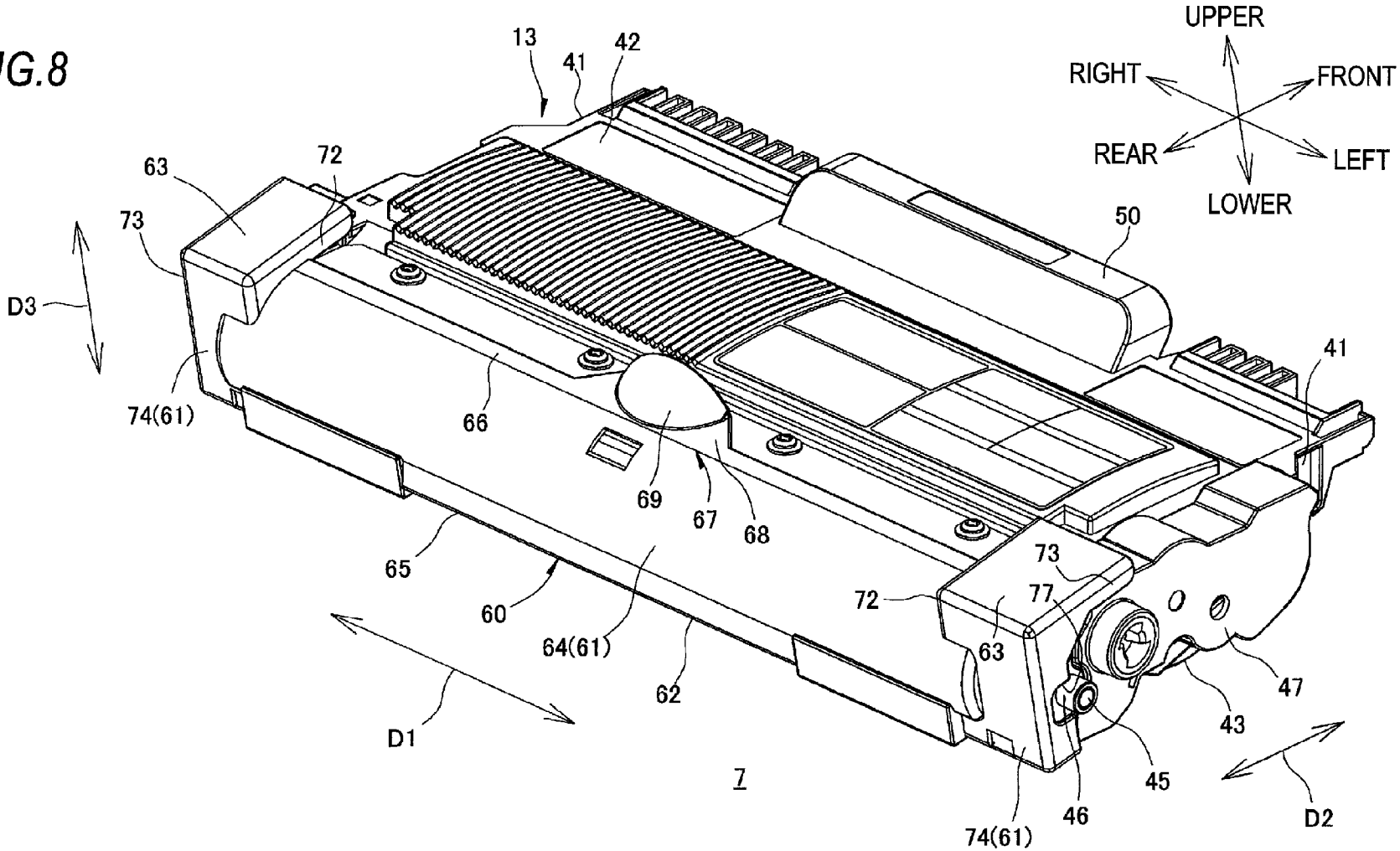
FIG. 8 is a perspective view illustrating a developing roller cartridge during an attachment operation of a developing roller cover.

As shown in FIGS. 6 and 7, the first opposite portion 62 integrally includes a tongue-shaped portion 83 and a lower wall portion 84.

The lower wall portion 84 extends toward a front portion from a lower end portion of the plate shaped portion 74 and is formed into a rectangular shape having a width nearly equal to the plate shaped portion 74 in the left-right direction as viewed from a plan view. A first tab 81 protruding upward is provided at the front end portion of the lower wall portion 84. As shown in FIG. 9B, when the developing roller cover 60 is attached to the developing cartridge 7, a first tab 81 is engaged with the first engaged portion 82 formed at the lower wall 43 of the housing 13.

Also, as shown in FIG. 5, the first opposite portion 62 is fitted to the lower wall 43 of the housing 13 from a rear lower side.

At a second end portion 66 of the circular arc portion 64, a center portion in the left-right direction is integrally formed with a cover handle portion 67, as one example of a handle portion. The cover handle portion 67 has an extending portion 68 and a dome portion 69.

The extending portion 68 is formed into a plate shape extending toward a front side from a second end portion 66 of the circular arc portion 64. As shown in FIG. 7, a front edge portion of the extending portion 68 is disposed in a rear side relative to the front edge portion of the tongue-shaped portion 83. In other words, the tongue-shaped portion 83 is protruded forward further than the front end portion of the extending portion 68.

Also, as shown in FIG. 6, a lower side surface of the extending portion 68 is formed with a third tab 70, which is protruded downward. The third tab 70 is disposed in the rear side (circular arc portion 64 side) of the front end portion of the cover handle portion 67. A front face of the third tab 70 is slanted in the front-rear direction and is formed into triangular shape as viewed from a side view. As shown in FIG. 5, when the developing roller cover 60 is attached to the developing cartridge 7, the third tab 70 is engaged with the third engaged portion 53 formed at the upper wall 42 of the housing 13.

The dome portion 69 protrudes upward, and the dome portion 69 is formed into an approximately quarter sphere shape which is opened toward a front side.

As shown in FIGS. 6 and 7, the second opposite portion 63 is formed continuously with a second end portion 66 of each of plate shaped portions 74 extending to the front side from the plate shaped portion 74 and is formed into rectangular shape as viewed from a plan view. As shown in FIG. 5, the second opposite portion 63 faces the upper wall 42 of the housing 13 from the above, when the developing roller cover 60 is attached to the developing cartridge 7. Also, as shown in FIG. 6, when the developing roller cover 60 is not being attached to the developing cartridge 7, the second opposite portion 63 faces the first opposite portion 62 with an unattached interval L1, as one example of a first interval.

An inner wall portion 72 extending toward the front side is provided at the inner edge portion of the left-right direction of the plate shaped portion 74. The inner wall portion 72 extends along the plate shaped portion 74 and the second opposite portion 63, and the inner wall portion 72 is formed into L-shape as viewed from a side view. An inner side surface of the inner wall portion 72 connected with an outer edge portion of the circular arc portion 64 in the left-right direction. Accordingly, the circular arc portion 64 and the plate shaped portion 74 are connected.

Also, an outer wall portion 73 extending toward the front side is provided at an outer edge portion of the plate shaped portion 74 in of the left-right direction. The outer wall portion 83 extends along the plate shaped portion 74 and the second opposite portion 63, the outer wall portion 83 is formed into L-shape as viewed from a side view. Also, a center portion of the outer wall portion 73 in the upper-lower direction is formed with a receiving portion 77 having an approximately rectangular notched shape from the front end. As shown in FIG. 2, when the developing roller cover 60 is attached to the housing 7, an inside of the receiving portion 77 receives the collar member 46 surrounding the developing roller shaft 45.

In addition, the lower end portion of the outer wall portion 73 and the plate shaped portion 74 is connected with a lower wall portion 84 of the first opposite portion 62.

4. Attachment/Detachment Operation of Developing Roller Cover on/from Developing Cartridge Hereinafter, an attachment/removal operation of a developing roller cover 60 on/from the developing cartridge 7 will be described, with mainly referencing to FIGS. 2, 5, 8, and 9.

(1) Attachment Operation of Developing Roller Cover

In the attachment operation of a developing roller cover 60 to the developing cartridge 7, first, the developing roller cover is disposed at the rear side of the developing cartridge 7. At this time, a protecting portion 61 in the developing roller cover 60 is disposed relatively at the rear side, and the first opposite portion 62 and the second opposite portion 63 is disposed at the relatively front side.

Thereafter, the developing roller cover 60 moves forward (i.e. developing cartridge 7 side), a front end of the first opposite portion 62 contacts a lower wall 43 of the housing 13.

When the developing roller cover 60 moves forward more, the first opposite portion 62 moves along a sheet convey rib 52 formed at the lower wall 43. Since the sheet convey rib 52 protrudes downward and inclines toward a front lower side, with the movement of the first opposite portion 62, an interval between the first opposite portion 62 and the second opposite portion 63 becomes larger than the un-attached interval L1 (refer to FIG. 6) as shown in FIG. 9. With the forward movement of the developing roller cover 60, a first tab 81 contacts a lower wall 42 of the housing 13. When the developing roller cover 60 moves forward further more, the first tab 81 slides along the lower surface of the lower wall 42 and an interval between the first opposite portion 62 and the second opposite portion 63 further increase and the interval is to be a maximum interval L3 (not shown), as one example of a second interval. In other words, the interval between the first opposite portion 62 and the second opposite portion 63 is enlarged with the movement of the first opposite portion 62.

Thereafter, the developing roller cover 60 moves forward more, a first tab 81 formed at the lower wall portion 84 of the first opposite portion 62 faces the first engaged portion 82 formed at a lower wall 43 of the housing 13, from the lower side. By restoring force of the developing roller cover 60, the first opposite portion 62 moves upward, and the first tab 81 engages with the first engaged portion 82. At this state, a first end portion 65 of the protecting portion 61 contacts the jaw portion 51 of the lower wall 43 from the front side. Thus, a further forward movement of the developing roller cover 60 is restricted.

Meanwhile, when a third tab 70 formed the an extending portion 68 of the protecting portion 61 is disposed at a position at which the third tab 70 faces a third engaged portion 73 formed at the upper wall 42 of the housing 13, by restoring force of the developing roller cover 60, the front end portion of the second opposite portion 63 moves downward, and the third tab 70 engaged with the third engaged portion 53. As a result, the second end portion 66 of the second opposite portion 63 contacts a layer-thickness restricting blade 85, and the attachment operation of the developing roller cover 60 to the developing cartridge 7 is completed.

When the attachment operation of the developing roller cover 60 is completed, the interval of the first opposite portion 62 and the second opposite portion 63 becomes a attached interval L2 (as one example of a final distance) which is smaller than the maximum interval L3 for a height H1 of the first tab 81 (refer to FIG. 9B) and a height H2 of the third tab 70 (refer to FIG. 5). In other words, the maximum interval L3 between the first opposite portion 62 and the second opposite portion 63 during the attachment operation of the developing roller cover 60 is subequal to a combined size, which combing of the attached interval L2 between the first opposite portion 62 and the second opposite portion 63, a height H1 of the first tab 81 and a height H2 of the third tab 70.

(2) Detachment Operation of Developing Roller Cover

In detachment operation of the developing roller cover 60 from the developing cartridge 7, the cover handle portion 67 is handled first. Specifically, a finger enters into the inner side of the dome portion 69 of the cover handle portion 67 or a finger is tucked into the dome portion 69, and an upper side of the dome portion 69 is handled.

After that, the cover handle portion 67 take upward. Since the first tab 81 is being engaged with the first engaged claw 82, with an upward movement of the cover handle portion 67, the developing roller cover 60 pivots relative to a contact portion (engagement portion) between the first tab 81 and the first engaged portion 82, as a rotation center. As a result, the extending portion 68 moves upward, and the third engaged portion 53 of the upper wall 42 the third tab 70 is detached, as shown FIGS. 8 and 9.

After the third tab 70 is detached from the third engaged portion 53, by moving rearward the developing roller cover 60, a detachment operation of the developing roller cover 60 from the developing cartridge 7 is completed.

5. Action and Effect

As described above, the housing 13 of the developing cartridge 7 is formed with the opening 40 extending in the left-right direction. The developing roller 18 is supported in the housing 14 so as to expose a portion of a circumference of the developing roller 18 from the opening 40. Also, a developing roller cover 60 for protecting the developing roller 18 is to be attached to the housing 13.

The developing roller cover 60 includes the protecting portion 61, the first opposite portion 62 and the second opposite portion 63, integrally. When the developing roller 18 is attached to the developing cartridge 7 (the attached state), the protecting portion 61 faces a circumference of the developing roller 18 and formed into a rectangular shape extending to the left-right direction. Accordingly, when the developing roller cover 60 is attached to the developing cartridge 7, the developing roller 18 is protected by the protecting portion 61, and the circumference of the developing roller 18 is prevented from damages.

A first end portion 65 of the lower side of the protecting portion 61 is provided continuously with the first opposite portion 62, which faces the housing 12 from a lower side when the developing roller cover 60 is attached to the developing cartridge. Also, a second end portion 66 of the upper side of the protecting portion 61 provided continuously with the second opposite portion 63, which faces the housing 13 from a upper side when the developing roller cover 60 is attached to the developing cartridge. That is, when the developing roller cover 60 is attached to the developing cartridge, the housing 13 is sandwiched by the first opposite portion 62 and the second opposite portion 63 from both sides of the upper-lower direction.

When the developing roller cover 60 is attached to the developing cartridge 7, the first opposite portion 62 fits the housing 13, the second opposite portion 63 is attached to a layer-thickness restricting blade 85 of the housing 13, and the interval between the first opposite portion 62 and the second opposite portion 63 becomes the attached interval L2. Also, during the attachment operation of the developing roller cover 60 to the developing cartridge 7, an interval between the first opposite portion 62 and the second opposite portion 63 becomes the maximum interval L3 larger than the attached interval L2. Therefore, during attachment operation, it is caused that restoring force makes the interval between the first opposite portion 62 and the second opposite portion 63 make into smaller. Accordingly, the housing 13 is sandwiched by the restoring force, and the attachment operation of the developing roller cover 60 to the housing 13 can be achieved. As a result, operability in attachment operation of the developing roller cover 60 can be improved.

Additionally, the first opposite portion 62 includes a first tab 81 to engage with the housing 13. The attached developing roller cover 60 with the housing 13 can be securely hold by the first tab 81 engaging to the housing 13. The posture of the developing roller cover 60 is maintained by the first opposite portion 62 and the second opposite portion 63, and the first tab 81 is engaged with the housing 13. Accordingly, the developing roller 18 is prevented from damages when the first tab 81 is engaged to the housing 13.

Additionally, the first opposite portion 62 has a tongue-shaped portion 83. When the developing roller cover 60 is attached to the developing cartridge 7. The tongue-shaped portion 83, extends from the protecting portion 61 further than first tab 81 the first opposite portion 13. Accordingly, during the attachment operation of the developing roller cover 60 to the developing cartridge 7, the tongue-shaped portion 83 contacts first the housing 13 before the contacting of the first tab 81. By contacting of the tongue-shaped portion 83 and the housing 13, the first opposite portion 62 is pushed and is enlarged to the lower side. Thus, the interval between the first opposite portion 62 and the second opposite portion 63 can be definitely increased in the upper-lower direction.

Additionally, the second opposite portion 63 is formed at both side portions of the second end portion 66 in the left-right direction of the protecting portion 61. Accordingly, the developing roller cover 60 can be securely supported at the housing 13 by both side portions in the left-right direction.

Additionally, when the developing roller cover 60 is attached to the developing cartridge, the second opposite portion 63 faces both of the left-right sidewalls 41. Accordingly, while both of the sidewalls 41 of the housing 13 are being sandwiched by the first opposite portion 62 and the second opposite portion 63, the developing roller cover 60 may be attached to the developing cartridge 7.

Additionally, a cover handle portion 67 is integrally formed a center portion of the protecting portion 61 in the left-right direction. Accordingly, a detachment operation of the developing roller cover 60 can be easily performed by handling the cover handle portion 67.

Additionally, the cover handle portion 67 has the extending portion 68 extending forward from the protecting portion 61. Accordingly, the cover handle portion 67 can be easily handled by the extending portion 68.

Additionally, the cover handle portion 67 protrudes upward having a dome portion 69 of approximately quarter sphere, which opens toward the front side. Accordingly, by putting a finger into the dome portion 69 or by hooking a finger to the dome portion 69, the cover handle portion 67 can be easily handled.

Additionally, the second opposite portion 63 is formed forward longer than the extending portion 68. Accordingly, when the developing roller cover 60 is detached from the developing cartridge 7, the extending portion 68 is separated from the housing 13 before the second opposite portion 63 is detached from the housing 13. Therefore, in the detachment operation of the developing roller cover 60, it can be prevented extending portion 68 from contacting the developing roller 18, so that the circumference of the developing roller 18 is prevented from damages.

Additionally, the cover handle portion 67 has the third tab to engage with the housing 13. The developing roller cover 60 attached to the housing 13 can be securely hold by the third tab 70 engaged with the housing 13.

An engagement of the third tab 70 to the housing 13 can be released by pivoting of the developing roller cover 60 relative to the contact portion between the first tab 81 and the first engaged portion 82, as a support point. In other words, to release the engagement of the third tab 70 to the housing 13, it is necessary to pivot the developing roller cover 60. Thus, it is prevent an engagement of the third tab 70 from not intended releasing, and it is prevent the developing roller cover 60 from dropping off the developing cartridge 7.

When the developing roller cover 60 is attached to the developing cartridge, a lower edge portion (lower wall 43) of the housing 13 faces the first end portion 65 of the protecting portion 61 in the front-rear direction, and the lower edge portion protrudes toward the rear side farther than a rear end portion of the circumference of the developing roller 18. Accordingly, since a space between the protecting portion 61 and the developing roller 18 can be securely formed, it is prevent from a contacting between the developing roller cover 60 and the developing roller 18 when the developing roller cover 60 is attached to the developing cartridge.

Additionally, when the developing roller cover 60 is attached to the developing cartridge, a upper edge portion (upper wall 42) of the housing 13 faces the second end portion 66 of the protecting portion 61 in the front-rear direction, and the upper edge portion is farther away from the protecting portion in the facing direction than the rear end portion of the circumference of the roller. Accordingly, when the developing roller 18 of the developing cartridge 7 contacts a photosensitive drum 9, a space between the housing of the drum cartridge 6 and the housing 13 of the developing cartridge 7 is securely formed, and the photosensitive drum 5 is exposed to the front upper side through the space. Thus, the laser beam from a exposing unit 22 can be irradiated to the circumference of the photosensitive drum 9.

6. Second Illustrative Aspect

Figure 10:
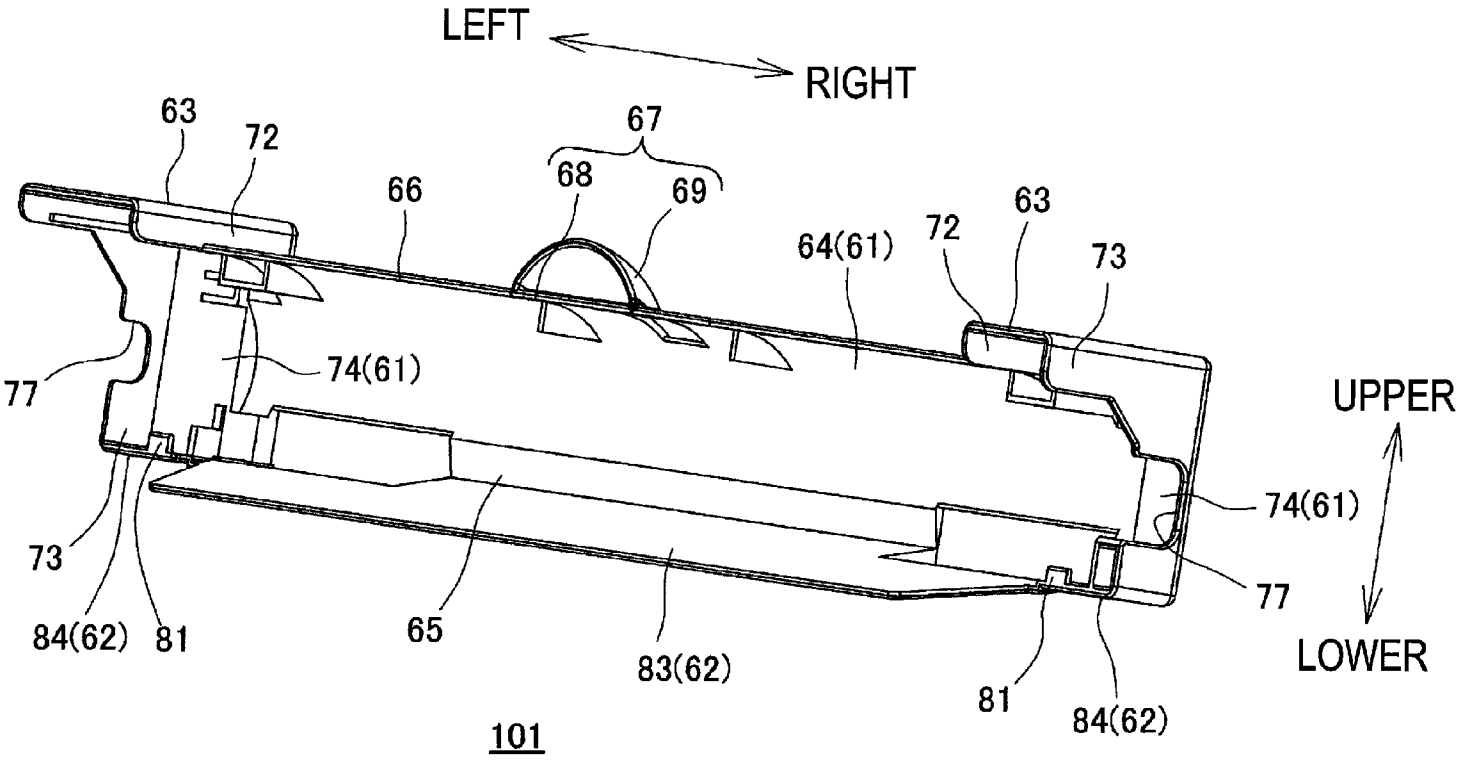
FIG. 10 is a perspective view illustrating a developing roller cover according to a second illustrative aspect of the present invention.

A developing roller cover 101, as shown in FIG. 10, may be used in stead of developing roller covers 60, as shown in FIGS. 6 and 7.

In the developing roller cover 101 shown in FIG. 10, a third tab 70 shown in FIG. 6 is not provided on a lower surface of the extending portion 68.

In this configuration, an interval between the first opposite portion 62 and the second opposite portion 63 during a attachment operation of the developing roller cover 101 to the developing cartridge 7 is larger than an un-attached interval L1, and restoring force is caused between these portions. Thus, the housing 13 of the developing cartridge 7 is sandwiched between the first opposite portion 62 and the second opposite portion 63. Thus, the attached developing roller cover 60 to the development cover 7 can be holed by the restoring force.

7. Third Illustrative Aspect

Figure 11:
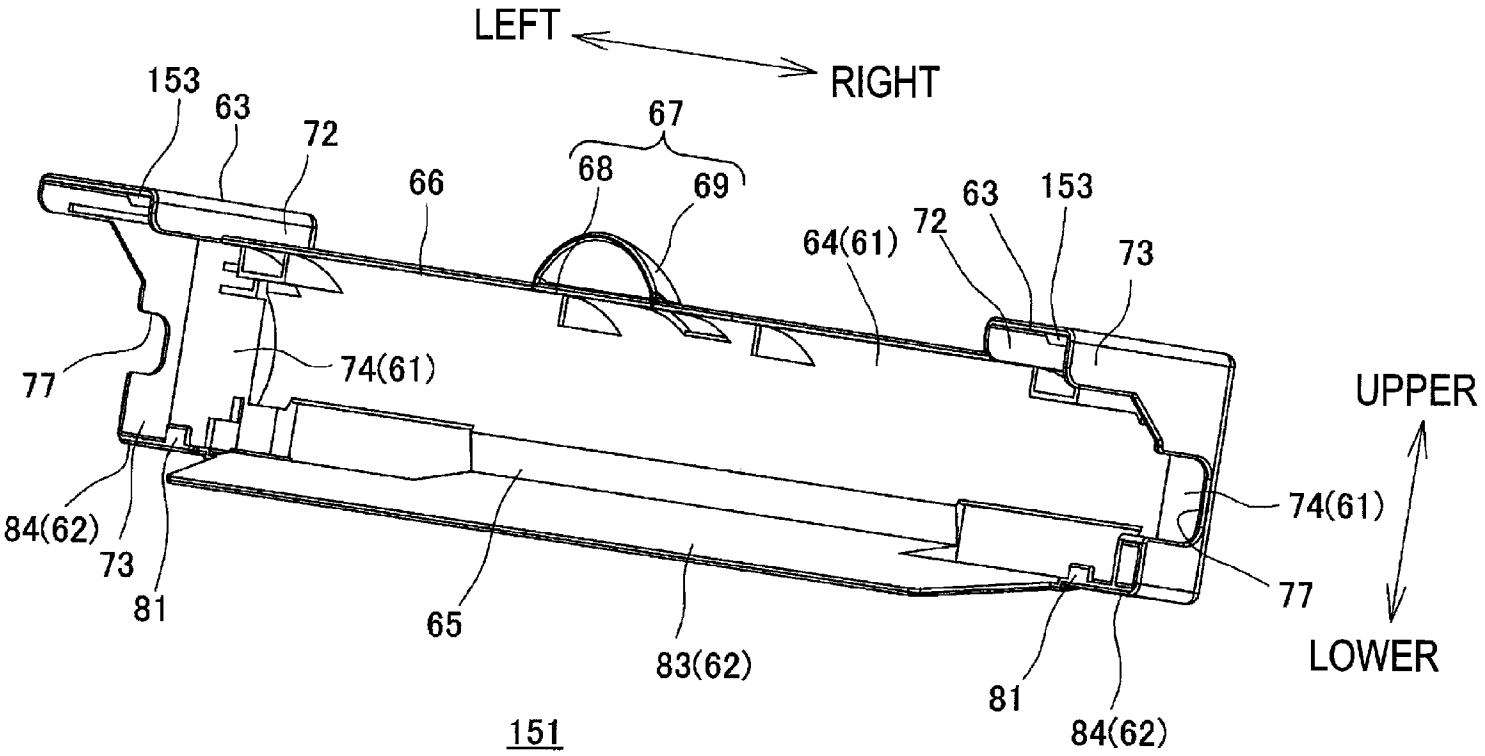
FIG. 11 is a perspective view illustrating a developing roller cover according to a third illustrative aspect of the present invention.

A developing roller cover 151, as shown in FIG. 11, may be used instead of developing roller covers 60, as shown in FIGS. 6 and 7.

In the developing roller cover 151 shown in FIG. 11, a second tab 153 protruded downward is formed on a lower surface of each of second opposite portions 63.

Meanwhile, a engaged portion (not shown) is formed at positions facing each of second tab 153 in the upper-lower direction, and each of engaged portions is to be engaged with a second tab 153. By this configuration, the same effect as the developing cartridge 7 and the developing roller cover 60 shown in FIG. 2 can be achieved.

Additionally, the second opposite portion 63 has a second tab 153 to engage with the housing 13. By the second tab 153 engaged with the housing 13, a attachment operation of the developing roller cover 60 to the housing 13 may be securely holded.

What is claimed is:

1. A developing cartridge comprising:

a housing configured to accommodate developer;

a developing roller configured to rotate with respect to a developing roller axis that extends in a longitudinal direction;

a collar member which covers an end portion of the developing roller axis in the longitudinal direction; and a cover configured to cover a circumference of the developing roller; the cover including:

a protecting portion, which extends in the longitudinal direction;

a first opposite portion, which extends in a facing direction that is perpendicular to the longitudinal direction from an end portion of the protecting portion in an orthogonal direction that is perpendicular to the longitudinal direction and the facing direction, the first opposite portion including a first tab configured to engage with the housing when the cover is attached to the housing; and an outer wall portion, which extends in the facing direction from an end portion of the protecting portion in the longitudinal direction and which has a first portion and a second portion, wherein the first portion extends in the orthogonal direction and faces the collar member in the facing direction, wherein the second portion extends in the facing direction and faces the collar member in the orthogonal direction;

wherein the cover has a handle portion that is provided in an end portion opposite to the first opposite portion in the orthogonal direction and a second tab that is configured to engage with the housing when the cover is attached to the housing, and wherein the handle portion and the second tab are provided at a central portion of the cover in the longitudinal direction.

2. The developing cartridge according to claim 1, wherein the handle portion protrudes from the end portion opposite to the first opposite portion in the orthogonal direction.

3. The developing cartridge according to claim 1, wherein a distance between the first opposite portion and the second tab in the orthogonal direction in a state where the cover has attached to the housing is a first distance, and wherein the cover is configured to transform so that the distance between the first opposite portion and the second tab in the orthogonal direction becomes a second distance while attaching the cover to the housing, and the second distance is larger than the first distance.

4. The developing cartridge according to claim 3, wherein the cover has a second opposite portion that extends in the facing direction from the end portion opposite the first opposite portion in the orthogonal direction, and wherein the handle portion and the second tab is provided on the second opposite portion.

5. The developing cartridge according to claim 3, further comprising a layer-thickness restricting blade configured to restrict a thickness of the developer on the developing roller, wherein the second tab is engaged with the a layer-thickness restricting blade.

6. The developing cartridge according to claim 1, wherein the protecting portion has an opening, and wherein the first tab is arranged to be overlapped with the opening as viewed from the facing direction.

7. The developing cartridge according to claim 1, wherein the outer wall portion has a notch portion configured to receive the collar member, and wherein the first portion and the second portion configure a part of the notch portion.

8. The developing cartridge according to claim 1, wherein the protecting portion has a bending portion that bends along the circumference of the developing roller.

9. A developing roller cover that is detachable with a cartridge including: a housing configured to accommodate developer; a developing roller configured to rotate with respect to a developing roller axis that extends in a longitudinal direction; and a collar member which covers an end portion of the developing roller axis in the longitudinal direction; the developing roller cover comprising:

a protecting portion, which extends in the longitudinal direction;

a first opposite portion, which extends in a facing direction that is perpendicular to the longitudinal direction from an end portion of the protecting portion in an orthogonal direction that is perpendicular to the longitudinal direction and the facing direction, the first opposite portion including a first tab configured to engage with the housing when the cover is attached to the housing; and an outer wall portion, which extends in the facing direction from an end portion of the protecting portion in the longitudinal direction and which has a first portion and a second portion, wherein the first portion extends in the orthogonal direction and faces the collar member in the facing direction, wherein the second portion extends in the facing direction and faces the collar member in the orthogonal direction, and wherein the cover has a handle portion that is provided in an end portion opposite to the first opposite portion in the orthogonal direction and a second tab that is configured to engage with the housing when the cover is attached to the housing, and wherein the handle portion and the second tab are provided at a central portion of the cover in the longitudinal direction.

10. The developing roller cover according to claim 9, wherein the handle portion protrudes from the end portion opposite to the first opposite portion in the orthogonal direction.

11. The developing roller cover according to claim 9, wherein a distance between the first opposite portion and the second tab in the orthogonal direction in a state where the cover has attached to the housing is a first distance, wherein the cover is configured to transform so that the distance between the first opposite portion and the second tab in the orthogonal direction becomes a second distance while attaching the cover to the housing, and the second distance is larger than the first distance.

12. The developing roller cover according to claim 9, wherein the cover has a second opposite portion that extends in the facing direction from the end portion opposite the first opposite portion in the orthogonal direction, and wherein the handle portion and the second tab are provided on the second opposite portion.

13. The developing roller cover according to claim 9, further comprising a layer-thickness restricting blade configured to restrict a thickness of the developer on the developing roller, wherein the third tab is engaged with the a layer-thickness restricting blade.

14. The developing roller cover according to claim 9, wherein the protecting portion has an opening, and wherein the first tab is arranged to be overlapped with the opening as viewed from the facing direction.

15. The developing roller cover according to claim 9, wherein the outer wall portion has a notch portion configured to receive the collar member, and wherein the first portion and the second portion configure a part of the notch portion.

16. The developing roller cover according to claim 9, wherein the protecting portion has a bending portion that bends along the circumference of the developing roller.

* * * * *